United States Patent [19]

McPhee

[11] 3,984,068

[45] Oct. 5, 1976

[54] VEHICLE GUIDANCE SYSTEM USING ANGULAR RATE OF CHANGE

[75] Inventor: Walter J. McPhee, Mishawaka, Ind.

[73] Assignee: The Bendix Corporation, South Bend, Ind.

[22] Filed: Aug. 28, 1972

[21] Appl. No.: 284,192

[52] U.S. Cl. ..... 244/3.19

[51] Int. Cl.[2] ..... F01B 15/02

[58] Field of Search ..... 244/3.14, 3.19; 235/61.5 E, 61.5 S, 150.25, 150.26, 150.27

[56] References Cited

UNITED STATES PATENTS

| | | | |
|---|---|---|---|
| 2,992,423 | 7/1961 | Floyd et al. | 235/150.26 X |
| 3,181,813 | 5/1965 | Gulick et al. | 244/3.19 |
| 3,215,368 | 11/1965 | Follin et al. | 244/3.19 X |
| 3,223,357 | 12/1965 | Bruecker-Steinkuhl | 244/3.19 |
| 3,260,478 | 7/1966 | Welti | 244/3.14 |
| 3,415,465 | 12/1968 | Bedford | 244/3.14 |
| 3,567,163 | 3/1971 | Kepp et al. | 244/3.14 |
| 3,660,648 | 5/1972 | Kuipers | 235/150.25 X |
| 3,706,429 | 12/1972 | Welford | 244/3.19 |

*Primary Examiner*—Verlin R. Pendegrass
*Attorney, Agent, or Firm*—Leo H. McCormick, Jr.; William N. Antonis

[57] ABSTRACT

In a vehicle guidance system, a method for computing the true rate of change of the angle between the line of sight to the target and the gyro reference. Two antennas are spaced apart a distance upon the vehicle. The outputs of both antennas are converted to a subcarrier frequency. One of the antenna outputs is then converted to a linear voltage by means of a phase detector and, subsequently, combined with the gyro reference voltage. By means of a high gain control loop and a voltage control oscillator, a combined sinusoid signal is given with both the carrier frequency and the gyro reference. In the high gain control loop, appropriate scaling factors and frequency division and multiplication must be used to eliminate repeating values of phase in excess of 360°. Now, by modulating the combined signal with the signal received from the other antenna, the carrier frequency can be eliminated. By further differentiation and multiplication, and the combining of the results thereof, a true rate of change of the angle between the gyro reference and the line of sight to the target can be obtained.

11 Claims, 3 Drawing Figures

VEHICLE GUIDANCE SYSTEM USING ANGULAR RATE OF CHANGE

BACKGROUND OF THE INVENTION

This invention relates to a guidance system of a vehicle, and, more specifically, to a guidance system that is dependent upon the rate of phase change between a gyro reference axis and the line of sight to a target. Previous to the present invention, numerous systems had information present in the form of a variable phase on a carrier signal with the significant information being the rate of phase change. Present methods for extracting the signal are to have an in between step of initial conversion to phase. This causes the normal discontinuities of a multivalued circular function plus the added electrical and mechanical parts. Herein is proposed a method for direct conversion of this phase modulated signal to a signal proportional to the rate of phase change. An elimination of the discontinuities will solve many of the problems in the homing guidance system. These previous systems have all required a second resolver, a servomotor and a motor-driven pentiometer. Because of the elimination of the servomotor and the motor-driven potentiometer, the present system can operate with a much higher carrier frequency. Also, the servomotor would give an angle instead of the desired angular rate of change.

In previous systems with information present as phase on an electrical carrier signal, it was sometimes necessary to introduce additional variables into the phase change. To remove a gyro signal from a body line of sight signal in the present guidance control system, the added variables are used to give a difference phase signal that represents the line of sight with respect to the stable gyro inertia reference axis.

The gyro signal needs to be scaled to the line of sight signal. Previous to the present invention, this operation was commonly done with the gearing of the gyro to resolver shafts, which was somewhat cumbersome and difficult. The gearing would have to be changed for different mechanical or electrical settings. The present invention allows for an electrical scaling of the gyro signal. However, simple amplitude adjustment of the gyro signal does not give a phase adjustment of the gyro signal. Therefore, the present invention proposes that a servo control loop be established with a phase discriminator and a voltage control oscillator for inner conversion of the phase carrier to a direct voltage signal proportional to the phase signals. This allows for a combination of circuits for implementation of an unlimited range with a linear, continuous phase modulation of a carrier with a conveniently accessible electrical signal setting for adjusting the scaling factor of the gyro reference signal. An invention that shows many of the prior problems just described, is Gulick et al, U.S. Pat. No. 3,181,813.

SUMMARY OF THE INVENTION

Accordingly, it is an object of this invention to provide a guidance system without a repeating discontinuous function in a phase modulation to angular rate of change conversion.

It is a further object of this invention to provide a guidance system that eliminates the need for a second resolver and a servomotor driving a potentiometer, thereby, allowing a higher frequency carrier signal.

It is a still further object of the present invention to provide a method for direct conversion of the phase modulated signal to a signal proportional to the rate of phase change. This is accomplished by a balance phase demodulator producing the sine and cosine of the phase term when the carrier term has been removed. The two phase terms are then differentiated, multiplied and summed to give the final desired rate of phase change.

It is still another object of the present invention to remove the gyro signal from the body line of sight signal in a guidance control system to give a difference phase signal that represents the line of sight with respect to the gyro reference axis. This is done by means of a linear phase detector which changes the carrier signal to a linear voltage which is summed with a gyro reference voltage. Thereafter, a high gain control loop containing a voltage control oscillator feeds back to the linear phase detector. This process will be explained in more detail in the present invention.

DESCRIPTION OF THE PREFERRED EMBODIMENT

Figure 1:
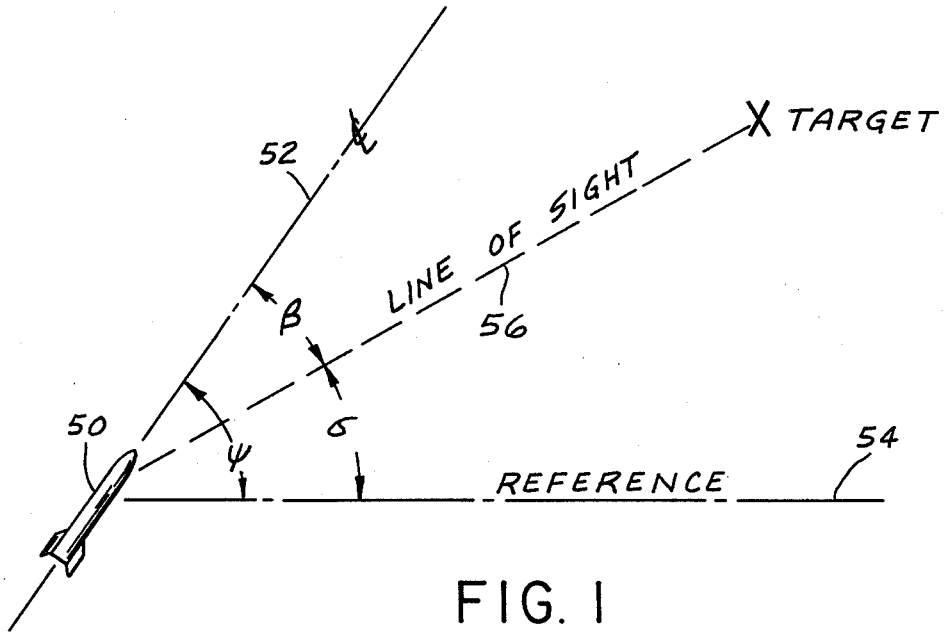
FIG. 1 is an angular representation showing the centerline of the missile line of sight to the target and the gyro reference.

Referring to FIG. 1 of the drawings, there is located a missile 50 along centerline 52. A target for the missile is represented by the letter X. The gyro reference is located along reference line 54, with the angle between the gyro reference line 54 and the centerline 52 being represented by the angle $\psi$. The angle between the line of sight 56 to the target X and the centerline 52 of the missile 50 is represented by the letter $\beta$. However, the desired information in the present case is the rate of change between reference line 54 and the line of sight 56. This angle between the reference line 54 and the line of sight 56 is represented by the letter $\sigma$ and will be proximated, as will be subsequently described, by the letter $\theta$. The movement of the missile 50 is in the approximate direction of the centerline 52.

Figure 2:
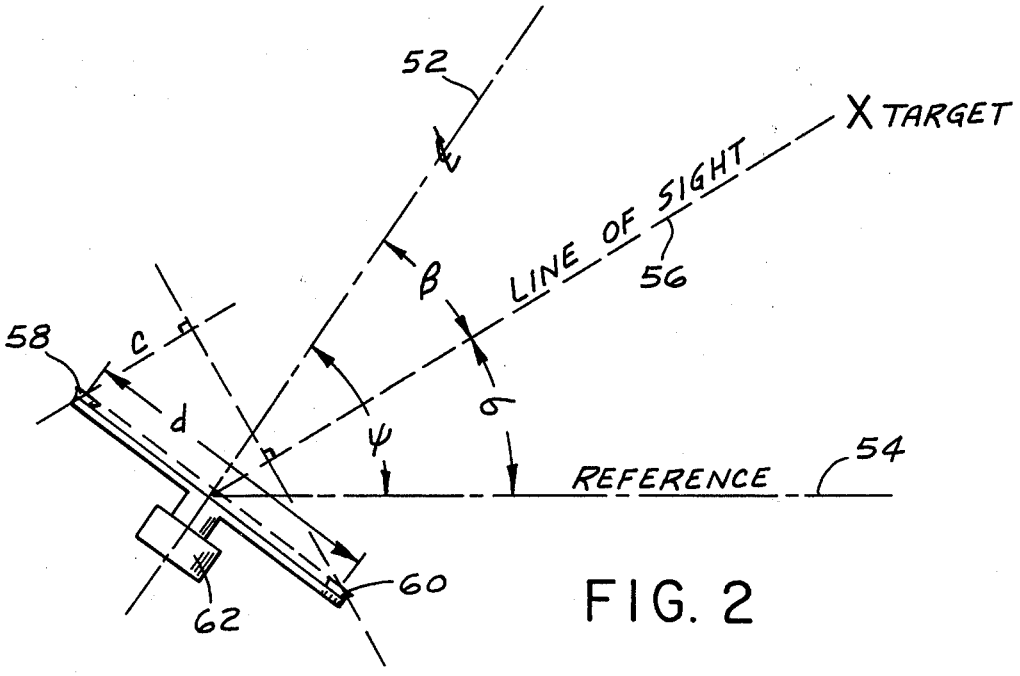
FIG. 2 is a further representation of FIG. 1, wherein the position and the location of the antennas on the missile are shown.

Referring now to FIG. 2, which will use similar numerals to designate similar parts as in FIG. 1, there is shown the antenna arrangement of two receiving antennas 58 and 60 as located on the missile 50. Both antennas 58 and 60 are located in a plane perpendicular to the centerline 52 of the missile 50. These two antennas 58 and 60 are separated by a distance $d$. A signal received by the antennas 58 and 60 is transmitted to the controls 62 and processed, as will be subsequently described. Clearly from the drawings in FIG. 1 and FIG. 2, any signal coming from the target X will be received by antenna 60 before it will be received by antenna 58. The extra distance a signal would travel before reaching antenna 58 from target X is repesented by the distance $c$.

Now, assuming the frequency of the incoming signal is represented by $W_o$, t represents the time and $\lambda$ represents the wave length, then the following functions 1 and 2 represent the signals received by the antennas 60 and 58, respectively. These functions are:

$$\cos W_o t \quad 1.$$

$$\text{Cos } W_o t + (2\pi d/\lambda) \sin \beta \quad 2.$$

In function 2, the $(2\pi d/\lambda) \sin \beta$ term represents the extra distance c traveled by a signal from target X before reaching antenna 58.

The signal received from target X is normally of a high frequency value as is represented by the $W_o$. Therefore, upon receiving the signal from the target X, the high frequency $W_o$ must be reduced down to a carrier frequency $W_s$. In the controls 62, shown as a block in FIG. 2 and in more detail in FIG. 3, the two functions 1 and 2 are fed into a converter 64 that changes $W_o$ to a carrier frequency $W_s$. Therefore, the two functions 1 and 2 are now represented by the following functions 3 and 4, respectfully, which are:

$$\cos W_s t \quad 3.$$

$$\cos(W_s t + 2\pi d/\lambda \sin \beta) \quad 4.$$

First, the processing of function 3 from phase locked loop 66 will be described. In systems with information present as phase on electrical carrier, it is sometimes necessary to introduce additional variables into the phase. In the present case, a gyro signal will be removed from a body line of sight signal in the guidance controls 62 to give a phase difference signal that represents the line of sight 56 with respect to the gyro reference 54. Any signal from a gyro needs to be scaled to the line of sight signal. A former method for doing this was by means of a gearing mechanism between a gyro and a resolver shaft with the resolver being used to modulate the carrier with the mechanical shaft position. Changing gears for different scaling was sometimes cumbersome and difficult. Therefore, it became desirable to enable changing by means of an electrical setting. The problem is that amplitude adjustment of a gyro signal does not give a phase adjustment of the gyro signal. It is herein proposed that phase detectors and a phase servo control loop be used for electrical scaling control 66 of the gyro signal.

Figure 3:
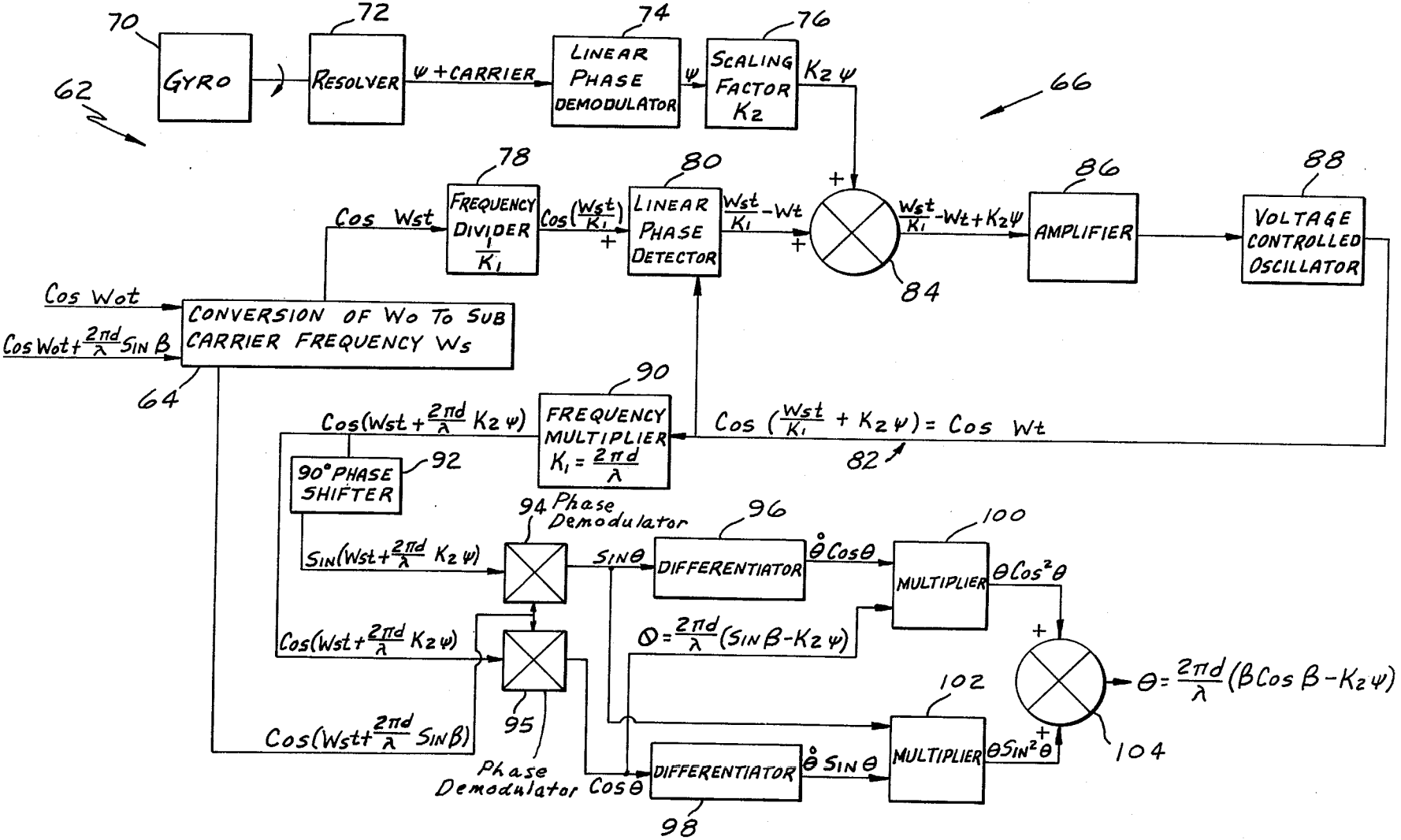
FIG. 3 is an illustrative block diagram of how the signals received by the two antennas in FIG. 2 can be used to give the rate of phase change between the reference and the line of sight.

Referring now to the gyro portion of the missile 50, the gyro in FIG. 3 is represented by numeral 70. The gyro 70 is mechanically connected to the resolver 72, which determines the gyro reference line 54. The output of resolver 72, as shown by function 5, has a relatively constant voltage represented by $\psi$ plus a carrier frequency. The function is:

$$\psi + \text{carrier} \quad 5.$$

Function 5 is then fed into linear phase modulator 74, which eliminates the carrier element of function 5. The output of linear phase demodulator 74 is scaled by a scaling factor $K_2$, represented by numeral 76 to give a function 6, which is:

$$K_2 \psi \quad 6.$$

The value of this scaling factor $K_2$ will be explained in more detail very shortly. Function 3 is fed into frequency divider 78 to give a resultant output represented by function 7, which is:

$$\cos (W_s t/K_1) \quad 7.$$

This frequency divider 78 can be flip flops in a counter configuration. Function 7 is fed into linear phase detector 80, which is part of control loop 82.

The control loop 82 gives a difference signal of the gyro 70 and the phase carrier represented by function 7 at a DC level. The output Wt is fed back and made equal to this difference by means of a high gain in the control loop 82. The output signal cos Wt of the control loop 82 and the reference carrier given by function 7 is converted to the difference of two DC signals by the linear phase detector 80. The linear phase detector 80 is used instead of a phase demodulator for two reasons. The linear phase range of the linear phase detector without sense reversal is $\pm\pi$, as compared with $\pm(\pi/2)$ for phase demodulation. The output of the linear phase detector 80 is a pulse started by the zero crossing of one phase and stopped by the zero crossing of the other to give a pulse width proportional to the phase difference, which is filtered for an average DC output. $\psi$ from the gyro 70 is also in DC form. Therefore, the output from the linear detector 80, as given by function 8, is combined with function 6 in summer 84 to give a resultant function 9. The functions 8 and 9 are:

$$(W_s t/K_1) - Wt \quad 8.$$

$$(W_s t/K_1) - Wt + K_2 \psi \quad 9.$$

Function 9 is then amplified by high gain amplifier 86 with the resultant signal being fed to voltage control oscillator 88. The voltage control oscillator 88 has an output represented by a feedback loop function 10, which is:

$$\cos Wt \text{ where } W = \frac{AK}{1+AKt}\left(\frac{W_s t}{K_1} + K_2\psi\right) \quad 10.$$

Function 10 is fed back into the linear phase detector 80 and subtracted out. By making the loop gain AK sufficiently large, the following equation 11 is true. The equation is:

$$Wt = (W_s t/K_1 + K_2 \psi \quad 11.$$

Referring back to the scaling factor $K_2$, the value of this scaling factor $K_2$ cannot exceed $\pi$. Otherwise the signal value range of the phase detector 80 would be exceeded. However, any additional scaling that is necessary can be accomplished by the frequency divider 78. The frequency divider 78 acts as a course adjustment with the scaling factor $K_2$ acting as a fine tuning mechanism. The scaling factor then becomes $K_1 K_2$. By making $K_1$ equal to $2\pi d/\lambda$, once the output of voltage control oscillator 88 is fed through frequency multiplier 90, function 12 is a result thereof. The function is:

$$\cos\left(W_s t + \frac{2\pi d}{\lambda} K_2 \psi\right) \quad 12.$$

For a little further description, the voltage control oscillator 88 can be a unijunction oscillator with transistor timing control, or it could be an astable multivibrator with dual transistor voltage control of frequency. The output in both cases would be a square wave which is suitable for the linear phase detector 80 or the frequency multiplier 90. With respect to the frequency multiplier 90, a transistor operating into cutoff in one swing and into self-biasing region on the other could serve as a multiplier stage of the frequency multiplier 90. By using the high gain control loop 82 as just described, an unlimited range, linear, continuous phase modulation of a carrier with an electrical means for setting the scaling factor can be obtained.

The following describes a process for direct conversion from phase modulated signal to phase angle rate for use in guidance systems or other systems depending upon the rate of change of phase between a received signal and its delayed counterpart. By using this approach, an in between conversion from phase to phase angle with its inherent circular function discontinuities is not necessary. The prime objective is to eliminate discontinuities that are prevalent in homing guidance systems. Function 12 from frequency multiplier 90 is fed into a phase shifter 92 with a resultant output reflected by functions 13 and 14. These functions are:

$$\sin (W_s t + (2 \pi d)/\lambda K_2 \psi) \qquad 13.$$

$$\cos (W_s t + (2 \pi d)/\lambda K_2 \psi) \qquad 14.$$

Thereafter, functions 13 and 14 are fed into dual balanced phase demodulators 94 and 95, which also receive function 4. The carrier frequency $W_s$ is then removed by the balance phase demodulators 94 and 95. Also, the balanced phase demodulators 94 and 95 have low pass filters to remove high frequency terms of the demodulator output. The outputs of the balance phase demodulators 94 and 95 are represented by functions 15 and 16. The functions are:

$$\sin \theta \qquad 15.$$

$$\cos \theta \qquad 16.$$

wherein $\theta$ is represented by equation 17, which is:

$$\theta = (2 \pi d/\lambda) (\sin \beta - K_2\psi) \qquad 17.$$

These functions 15 and 16 from demodulators 94 and 95 are differentiated by differentiators 96 and 98, respectively. After differentiator 96 differentiates function 15, it gives function 18, which is:

$$\dot{\theta} \cos \theta \qquad 18.$$

Thereafter, function 18 is fed into multiplier 100 along with function 16 to give an output function 19, which is:

$$\dot{\theta} \cos^2 \theta \qquad 19.$$

Simultaneously, function 16 is fed into differentiator 98 which differentiates function 16 to obtain function 20, which follows:

$$\dot{\theta} \sin \theta \qquad 20.$$

Function 20 is then fed into multiplier 102 which also receives function 15. Therefore, the output of multiplier 102 is the following function 21. The function is:

$$\dot{\theta} \sin^2 \theta \qquad 21.$$

Functions 19 and 21 are now fed into summer 104 to give function 22. The function 22 is:

$$\dot{\theta} \sin^2 \theta + \dot{\theta} \cos^2 \theta = \dot{\theta} (\sin^2 \theta + \cos^2 \theta) = \dot{\theta} \qquad 22.$$

to give $\dot{\theta}$, that is represented by the following equation 23:

$$\dot{\theta} = \frac{2\pi d}{\lambda}(\dot{\beta} \cos \beta - K_2 \dot{\psi}) \qquad 23.$$

The constant $K_2$ is made equal to $\cos \beta$ which in turn makes $\dot{\theta}$ proportional to the reference line of sight rate $\dot{\sigma}$ as desired. Therefore, the output $\dot{\theta}$ relationship is proportional to $\dot{\sigma}$ by the following equation. The equation is $$\dot{\theta} = \dot{\sigma} \frac{2\pi d}{\lambda} \cos \beta \qquad 24.$$

The circuitry just described eliminates the need for a second resolver and a servomotor with a motor-driven potentiometer. In conventional systems, the servomotor with the follow up resolver provides a phase to angle conversion. This angle that would be present in a shaft position is converted into an electrical output with a driven potentiometer. The electrical output is then differentiated for angle rate. The present system, herein described, eliminates the present repeating discontinuous function in the phase modulation to angle conversion. Another benefit in the present system is the reduced circuitry in the receiver made possible by the use of a higher frequency which could not have been previously used because of the servomotor. The circuitry reduction comes through the omission of the last carrier step down conversion in the guidance receiver.

I claim:

1. A guidance system for bringing a vehicle and a target together, said system comprising:

antenna means located on said vehicle for receiving an energy wave front from said target;

means for converting said energy received from said wave front to a low frequency signal;

gyro means for producing a reference signal;

means for combining said low frequency signal from said antenna means with said reference signal to give a combined signal, said combining means having a feedback control loop;

means for demodulating said combined signal with said low frequency signal from said antenna means to remove carrier frequencies from said low frequency signal angle to give an approximate trigometric angle between said reference signal angle and a line of sight signal to said target;

means for differentiating said approximate trigometric signal angle to get a rate of change signal times said approximate trigometric signal angle; and processing means for eliminating said approximate trigometric signal angle to give a signal correlative to said rate of change in one plane of said line of sight to said target.

2. The guidance system, as recited in claim 1, wherein said combining means includes:

means for linear phase detection to convert said low frequency signal to a detector voltage;

first means for summing said detector voltage with said reference signal to give a summed voltage; and high gain amplifying means feeding said summed voltage back to said linear phase detection means to give said combined signal.

3. The guidance system, as recited in claim 2, wherein:

said converting means includes a means for dividing said low frequency signal by a first constant signal;

said gyro signal includes a scaling factor less than $\pi$; and said combining means includes a means for multiplying said combined signal by said first constant signal.

4. The guidance system, as recited in claim 3, further comprising a means for phase splitting said combined signal, both phase outputs of said phase splitting means being fed into said demodulating means, said demodulating means being of a balanced type to produce both sine signal and cosine signal outputs respectively of said approximate trigometric angle.

5. The guidance system, as recited in claim 4, wherein:

said differentiating means differentiates both said sine signal and cosine signal outputs of said approximate trigometric angle signal; and said processing means includes multiplying means and a second summing means for eliminating said approximate trigometric angle signal.

6. A system for guiding a vehicle toward a target comprising:

means for receiving a signal from said target by at least two antenna means, a first of said antenna means being spaced from a second of said antenna means on said vehicle;

gyro means on said vehicle for producing a reference line signal that is represented by a reference voltage;

means for combining said reference voltage with an output from said first antenna means, said combining means giving a combined signal which includes the gyro reference voltage and said first antenna means output;

means for eliminating the carrier frequency signal components of said combined signal and an output from said second antenna means to give a first signal representing an angle between the target and the reference line signal, said second antenna means output including a time difference relationship which corresponds to the difference in distance said first signal must travel to reach said second antenna means as compared to said first antenna means; and means for processing said first signal to provide a second signal corresponding to angular rate of change of a line of sight to said target and said reference line.

7. The system for guiding a vehicle toward a target, as recited in claim 6, wherein:

said eliminating means includes a balanced phase demodulator means that gives a sine signal output and cosine signal output; and said means for processing includes a differentiating means and a multiplier means to give said rate of change times the square of said sine signal output and cosine signal output, said processing means then summing the rate of change signal times the square of the sine signal output and the cosine signal output to give said rate of change.

8. The system for guiding a vehicle toward a target, as recited in claim 7, wherein said eliminating means further includes a means for phase splitting said combined signal, phase outputs of said phase splitting means being fed into said balanced phase demodulating means.

9. The system for guiding a vehicle toward a target, as recited in claim 6, wherein said combining means includes:

voltage control oscillator means;

means for linear phase detection to give a voltage proportional to the phase difference between the first antenna means and a voltage controlled oscillator output;

means for summing said proportional voltage and said reference voltage;

high gain amplifying means connected to the output of said summing means to produce a high gain loop connected to said linear phase detection means, said voltage control oscillator means being inserted in said high gain loop to reproduce said carrier frequency signals.

10. The system for guiding a vehicle toward a target, as recited in claim 9, wherein:

said reference voltage is scaled by a factor less than $\pi$;

said first antenna means output is divided in frequency by a constant signals; and said combined signal being multiplied in frequency by said constant signals.

11. A guidance system for aligning a vehicle with a target, said system comprising:

first antenna means located on said vehicle for receiving a first signal from said target;

second antenna means located on said vehicle a fixed distance from said first antenna means for receiving a second signal from said target;

means connected to said first antenna means for converting said first signal into a low frequency signal;

gyro means for producing a reference signal;

means for combining said low frequency signal with said reference signal to create a combined signal;

means for demodulating said combined signal with said second signal to remove carrier frequency signal components from said second signal to provide a signal correlative to an approximate trigometric angle between said reference signal and a line of sight to said target;

means for differentiating said approximate trigometric angle signal to obtain a rate of change times said approximate trigometric angle signal; and processing means for eliminating said approximate trigometric angle signal to obtain a signal correlative to said rate of change in one plane of said line of sight to said target.

* * * * *